US008236087B2

(12) United States Patent
Mitani et al.

(10) Patent No.: US 8,236,087 B2
(45) Date of Patent: Aug. 7, 2012

(54) POWDER CORE AND IRON-BASE POWDER FOR POWDER CORE

(75) Inventors: Hiroyuki Mitani, Kobe (JP); Nobuaki Akagi, Takasago (JP); Hirofumi Houjou, Takasago (JP); Chio Ishihara, Matsudo (JP); Makoto Iwakiri, Matsudo (JP); Sohei Yamada, Kosai (JP); Yasukuni Mochimizo, Kosai (JP)

(73) Assignees: Kobe Steel, Ltd., Kobe-shi (JP); Hitachi Powdered Metals Co., Ltd., Matsudo-shi (JP)

( * ) Notice: Subject to any disclaimer, the term of this patent is extended or adjusted under 35 U.S.C. 154(b) by 45 days.

(21) Appl. No.: 12/440,779

(22) PCT Filed: Sep. 11, 2007

(86) PCT No.: PCT/JP2007/067660

§ 371 (c)(1),
(2), (4) Date: Mar. 11, 2009

(87) PCT Pub. No.: WO2008/032707

PCT Pub. Date: Mar. 20, 2008

(65) Prior Publication Data

US 2009/0226751 A1 Sep. 10, 2009

(30) Foreign Application Priority Data

Sep. 11, 2006 (JP) ..... 2006-245920

(51) Int. Cl.
*B22F 1/02* (2006.01)
*H01F 1/06* (2006.01)

(52) U.S. Cl. ..... 75/252; 148/105

(58) Field of Classification Search ..... 75/252, 75/246; 419/66

See application file for complete search history.

(56) References Cited

U.S. PATENT DOCUMENTS

| | | | | |
|---|---|---|---|---|
| 6,054,219 | A * | 4/2000 | Satsu et al. | 428/403 |
| 6,638,335 | B2 * | 10/2003 | Ozaki et al. | 75/255 |
| 2004/0191519 | A1 * | 9/2004 | Kejzelman et al. | 428/407 |
| 2007/0235109 | A1 * | 10/2007 | Maeda et al. | 148/307 |
| 2007/0243400 | A1 * | 10/2007 | Miyahara et al. | 428/546 |
| 2008/0041496 | A1 | 2/2008 | Maeda et al. | |
| 2008/0152897 | A1 | 6/2008 | Maeda et al. | |

FOREIGN PATENT DOCUMENTS

| | | | |
|---|---|---|---|
| GB | 2430682 | * | 4/2007 |
| JP | 53-76107 | | 7/1978 |
| JP | 6 2007 | | 1/1994 |
| JP | 2002 121601 | | 4/2002 |
| JP | 2003 92211 | | 3/2003 |
| JP | 2003-142310 | * | 5/2003 |
| JP | 2005 133168 | | 5/2005 |
| JP | 2005 281805 | | 10/2005 |
| JP | 2006 24869 | | 1/2006 |
| JP | 2006 128663 | | 5/2006 |
| JP | 2006 202956 | | 8/2006 |

OTHER PUBLICATIONS

U.S. Appl. No. 12/670,750, filed Jan. 26, 2010, Mitani, et al.

Maeda, Toru, et al., "Development of Low-iron-loss Sintered Magnetic Material", Sumitomo Electric Industries, Ltd., vol. 166, pp. 1-6, 2005, (with English translation).

U.S. Appl. No. 12/439,861, filed Mar. 4, 2009, Mitani, et al.

U.S. Appl. No. 12/368,413, filed Feb. 10, 2009, Ohwaki, et al.

Chinese Office Action issued May 19, 2011, in Patent Application No. 200780033537.6 (with English-language translation).

Extended Search Report issued Sep. 2, 2011 in Europe Application No. 07807069.5.

* cited by examiner

*Primary Examiner* — Roy King
*Assistant Examiner* — Ngoclan T Mai
(74) *Attorney, Agent, or Firm* — Oblon, Spivak, McClelland, Maier & Neustadt, L.L.P.

(57) ABSTRACT

The present invention relates to an iron-base powder for a powder core, wherein when cross-sections of at least 50 iron-base powders are observed and a crystal grain size distribution containing at least a maximum crystal grain size is determined by measuring a crystal grain size of each iron-base powder, 70% or more of the measured crystal grains are a crystal grain having a crystal grain size of 50 μm or more. According to the iron-base powder of the invention, a coercivity of the powder core can be made small and a hysteresis loss can be reduced.

8 Claims, No Drawings

POWDER CORE AND IRON-BASE POWDER FOR POWDER CORE

TECHNICAL FIELD

The present invention relates to an iron-base powder for a powder core used in producing a powder core for electromagnetic parts by compacting a soft magnetic iron-base powder such as iron powder or iron-base alloy powder (hereinafter these are sometimes collectively referred to as a "iron-base powder").

BACKGROUND ART

As for the magnetic core (core material) of an electromagnetic part (e.g., motor) used with an alternating current, a magnetic core obtained by laminating an electromagnetic steel sheet, an electrical iron sheet or the like has been heretofore used. However, in recent years, a powder core produced by compacting a soft magnetic iron-base powder and annealing this for strain relief is put into use. Compacting of an iron-base powder brings about a high shape latitude and enables easy production of even a three-dimensionally shaped magnetic core. Accordingly, as compared with a magnetic core produced by laminating an electromagnetic steel sheet, an electronic iron sheet or the like, downsizing or lightweighting becomes possible. Also, after compacting, strain-relief annealing is performed, whereby the strain introduced at the production or compacting of the raw material powder can be relieved and the core loss, particularly hysteresis loss, can be reduced.

The powder core produced by compacting an iron-base powder exhibits good electromagnetic conversion property in a high frequency band of, for example, 1 kHz or more, but in the drive conditions under which the motor is generally working [for example, at a drive frequency of several hundreds of Hz to 1 kHz and a drive magnetic flux of 1 T (tesla) or more], the electromagnetic conversion property is likely to deteriorate. When the change of magnetic flux inside of the material is in a region of not involving a relaxation phenomenon (e.g., magnetic resonance), the deterioration of electromagnetic conversion property [that is, energy loss (core loss) at the magnetic conversion] is known to be expressed by the sum of hysteresis loss and eddy-current loss (see, for example, Non-Patent Document 1).

Out of these losses, the hysteresis loss is considered to correspond to the area of a B—H (magnetic flux density-magnetic field) curve. The factor affecting the shape of this B—H curve and governing the hysteresis loss includes the coercivity (loop width of B—H curve), the maximum magnetic flux density and the like of the powder core. In other words, the hysteresis loss is proportional to the coercivity and therefore, for reducing the hysteresis loss, this may be attained by reducing the coercivity.

On the other hand, the eddy-current loss is a joule loss of the induced current associated with an electromotive force generated by electromagnetic induction according to a change in the magnetic field. This eddy-current loss is considered to be proportional to the change rate of magnetic field, that is, the square of frequency, and as the electric resistance of the powder core is smaller or as the range in which an eddy current flows is larger, the eddy-current loss becomes larger. The eddy current is roughly classified into an intraparticle eddy current that flows in individual iron-base powder particles and an interparticle eddy current that flows across between iron-base powder particles. Accordingly, when electrical insulation among individual iron-base powders is complete, the interparticle eddy current is not generated and only the intraparticle eddy current flows, so that the eddy-current loss can be reduced.

Meanwhile, with respect to deterioration of the electromagnetic conversion property, in a low-frequency band at which the motor is generally working (for example, from several hundreds of Hz to 1 kHz), the hysteresis loss is more governing than the eddy-current loss and it is demanded to reduce the hysteresis loss.

In regard to the technique for reducing the hysteresis loss, Non-Patent document 1 discloses a technique aiming at characteristic improvements while paying attention to achieving a low coercivity of a magnetic powder by the elevation of purity and the reduction in intraparticle strain, achieving a high density of the green compact, achieving high electrical resistance, and enhancing the heat resistance by the improvement of insulating film. However, this technique lacks general-purpose applicability, because an iron-base powder made to have a high purity by reducing the amount of impurities inevitably contained in the iron-base powder needs to be used and an iron-base powder commercially available in general cannot be used.

On the other hand, Patent Document 1 proposes a pure iron powder for powder metallurgy, which is a coarse crystal grain having a particle size construction such that, in terms of the sieve weight ratio (%) determined using a sieve defined in JIS Z8801, a portion passed through a −60/+83 mesh accounts for 5% or less, a portion through a −83/+100 mesh accounts for 4% or more and 10% or less, a portion passed through a −100/+140 mesh accounts for 10% or more and 25% or less, and a portion passed through a 330 mesh accounts for 10% or more and 30% or less, where the average crystal grain size of the portion passed through a −60/+200 mesh is 6.0 or less according to a measurement method for ferrite crystal grain size defined in JIS. In Patent Document 1, it is indicated that when the ferrite crystal grain size is increased, the magnetic field is reduced for the soft magnetic property and this is advantageous from the standpoint of deterring the formation of a magnetic domain as well as in view of internal loss. However, in Patent Document 1, a coarse particle failed in passing through a 60 mesh (a sieve having a sieve opening of 250 μm) is not used so as to avoid impairment of the homogeneity of the green compact and generation of a defect in terms of strength.

Also, Patent Document 2 describes a technique of setting, in the cut surface of a metal powder particle, the number of crystal grains in one metal powder particle to 10 or less on average and indicates that reduction in the number of crystal gains may be attained by a method of heating the metal powder particle at a high temperature in a heating atmosphere. However, according to the study by the present inventors on the technique disclosed in Patent Document 2, there is a case where even when the number of crystal grains in individual metal powder particles is controlled, the magnetic permeability of the powder core is not improved and the hysteresis loss cannot be reduced. Accordingly, the core loss of the powder core is not sufficiently improved in some cases.

Non-Patent Document 1: SEI Technical Review, No. 166, pp. 1-6, issued by Sumitomo Electric Industries, Ltd. (March, 2005)

Patent Document 1: JP-A-6-2007

Patent Document 2: JP-A-2002-121601

DISCLOSURE OF THE INVENTION

The invention has been made under these circumstances, and an object of the invention is to provide an iron-base powder for a powder core, which enables achieving a small coercivity of the powder core and reducing the hysteresis loss. Another object of the invention is to provide an iron-base powder for a powder core, which enables reducing the eddy-current loss as wells as the hysteresis loss and thereby reducing the core loss of the powder core. Still another object of the invention is to provide a powder core with low core loss.

In consideration of the technique disclosed in JP-A-2002-121601, the present inventors have made intensive studies on the relationship between the coercivity of a powder core and the crystal grain of an iron-base powder constituting the powder core with an attempt to reduce the hysteresis loss of the powder core. As a result, it has been found that the coercivity of a powder core is governed not by the number of crystal grains but by the size of the crystal grain size, and in particular, the small crystal grain size adversely affects the coercivity. The invention has been accomplished based on this finding.

That is, the invention relates to the following (1) to (7).

(1) An iron-base powder for a powder core, wherein when cross-sections of at least 50 iron-base powders are observed and a crystal grain size distribution containing at least a maximum crystal grain size is determined by measuring a crystal grain size of each iron-base powder, 70% or more of the crystal grain size is 50 μm or more.

(2) The iron-base powder according to (1), wherein when the iron-base powder is sieved using a sieve having a sieve opening of 75 μm, the iron-base powder which does not pass through the sieve accounts for 80 mass % or more.

(3) The iron-base powder according to (1) or (2), wherein an insulating film is formed on a surface of the iron-base powder.

(4) The iron-base powder according to (3), wherein the insulating film is a phosphoric acid-based chemical film.

(5) The iron-base powder according to (4), wherein the phosphoric acid-based chemical film contains one or more elements selected from the group consisting of Na, S, Si, W and Co.

(6) The iron-base powder according to (4) or (5), wherein a silicone resin film is further formed on a surface of the phosphoric acid-based chemical film.

(7) A powder core obtained by compacting the iron-base powder according to any one of (3) to (6), wherein the powder core has a green density of 7.5 g/cm$^3$ or more.

According to the invention, the crystal grain size constituting individual iron-base powders is made large, whereby the coercivity of the powder core becomes small and in turn, the hysteresis loss can be reduced. Also, according to the invention, an insulating film is formed on the surface of the iron-base powder made to have a large crystal grain size and the eddy-current loss as well as the hysteresis loss can be thereby reduced, so that an iron-base powder capable of producing a powder core reduced in the core loss can be provided. Furthermore, according to the invention, a powder core reduced in both the hysteresis loss and the eddy-current loss and having a small core loss can be provided.

BEST MODE FOR CARRYING OUT THE INVENTION

The invention is described in detail below. In the context of the invention, the percentage and the like defined by the mass all are the same as those defined by the weight.

In the iron-base powder for a powder core of the invention, when the cross-section of the iron-base powder is observed and a crystal grain size distribution containing at least a maximum crystal grain size is determined by measuring the crystal grain size of each iron-base powder, 70% or more of the crystal grain has a crystal grain size of 50 μm or more. By increasing the number of iron-base powder particles having a crystal grain size of 50 μm or more, as illustrated in Examples later, the coercivity of the powder core can be made small, as a result, the hysteresis loss can be reduced. The proportion of the iron-base powder having a crystal grain size of 50 μm or more is preferably 80% or more, more preferably 90% or more.

Also, the crystal grain size is preferably 55 μm or more, more preferably 60 μm or more. More specifically, when the cross section of the iron-base powder is observed and a crystal grain size distribution containing at least a maximum crystal grain size is determined by measuring the crystal grain size of each iron-base powder, 70% or more (preferably 80% or more, more preferably 90% or more) of the crystal grain preferably has a crystal grain size of 55 μm or more, more preferably 60 μm or more.

The crystal grain size may be measured by the following procedure. The iron-base powder is embedded in a resin, this was cut to expose the cross section of the iron-base powder, the cross section of the iron-base powder is mirror-polished, the mirror-polished cross section is etched with nital, the resulting cross section is observed and photographed by an optical microscope, for example, at a magnification of 100 to 400, and an image analysis is performed by tracing objective crystal grains on the photograph. In the image analysis, the gravity center of the object to be analyzed is determined using an image processing program "Image-Pro Plus" (produced by Media Cybernetics, U.S.A.), a straight line is drawn on the object to pass the gravity center, the distance between intersections of the object with the outer circumferential line is measured, and by measuring the distance in 2° steps at 180 points, the average of the measurement results is defined as the crystal grain size.

The maximum value out of the crystal grain sizes measured is defined as the maximum crystal grain size, and a crystal grain size distribution by number containing at least the maximum crystal grain size and covering three or less major crystal grain sizes measured is produced. The distribution by number is specified to contain at least the maximum crystal grain size, because a large crystal grain size contributes to the reduction in the hysteresis loss. Also, the distribution by number is specified to cover three or less major crystal grain sizes, because when the cross section of the iron-base powder is observed, there may be a case where the iron-base powder consists of two crystal grains or one crystal grain (that is, single crystal).

The number of iron-base powders used for measuring the crystal grain size is at least 50. The number of iron-base powders used for measuring the crystal grain size is preferably as large as possible and may be 60 or more or may be 70 or more. Accordingly, the number measured for the crystal grain size is also at least 50. The number measured for the crystal grain size is preferably as large as possible and may be 60 or more or may be 70 or more.

In consideration of the particle size distribution of the iron-base powder, the iron-base powder used for measuring the crystal grain size is selected not to produce extreme variation in the particle diameter of the iron-base powder. Because, the crystal grain cannot grow over the particle diameter and therefore, when the cross-sectional diameter of the iron-base powder when measuring the crystal grain size is smaller than the particle diameter, the crystal grain size of the iron-base powder cannot be exactly measured, whereas when the cross-sectional diameter of the iron-base powder when measuring the crystal grain size is larger than the particle diameter, the crystal grain size of an excessively grown crystal grain may be measured and the measurement accuracy decreases. Also, even if the cross-sectional diameter of the iron-base powder is within the particle size distribution, the measurement accuracy becomes bad either when the crystal grain size of mainly the iron-base powder having a relatively small cross-sectional diameter is measured or when the crystal grain size of mainly the iron-base powder having a relatively large cross-sectional diameter is measured, and therefore, the iron-base powder is selected not to produce variation. Accordingly, when the particle size of the iron-base powder is, for example, from 75 to 250 μm, the crystal grain size in a powder where the cross-sectional diameter of the iron-base powder is from 75 to 250 μm is measured. Incidentally, the cross-sectional diameter may be measured by the same procedure as in measuring the crystal grain size.

As to means for measuring the crystal grain size and simply calculating the proportion of the number of crystal grains having a crystal grain size of 50 μm or more in the number of crystal grains measured, when the cross section of the iron-base powder is observed and a distribution of the crystal grain size is prepared by measuring the crystal grain size of crystal grains observed in the cross section of the iron-base powder, it may be sufficient when the crystal grain size of crystal grains corresponding to 30% (hereinafter sometimes referred to as D30) counted from the minor crystal grain size side is 50 μm or more.

The iron-base powder of the invention is preferably a powder where when sieved using a sieve having an sieve opening of 75 μm, the portion which does not pass through the sieve (a portion remaining on the sieve) accounts for 80 mass % or more. This is for minimizing the proportion of the iron-base powder having a small crystal grain size as much as possible by reducing the percentage of the iron-base powder having a small particle diameter. The percentage of the iron-base powder having a particle diameter of 75 μm or more is preferably 90 mass % or more, more preferably 95 mass % or more, still more preferably 99 mass % or more.

The particle diameter of the iron-base powder is preferably larger and is preferably 106 μm or more, more preferably 150 μm or more. More specifically, an iron-base powder causing, when sieved using a sieve having a sieve opening of 106 μm, 80 mass % or more to fail in passing through the sieve is preferred, and an iron-base powder causing, when sieved using a sieve having a sieve opening of 150 μm, 80 mass % or more to fail in passing through the sieve is more preferred. Incidentally, the upper limit of the particle diameter of the iron-base powder is not particularly limited, but when the particle diameter becomes excessively large, this may incur bad filling into minute parts of a die cavity when the iron-base powder is filled in a die cavity or may give rise to small strength of the powder core. Accordingly, an iron-base powder allowing, when sieved using a sieve having a sieve opening of 425 μm, the portion having a particle diameter of 425 μm or more to account for 10 mass % or less is preferred, and an iron-base powder allowing, when sieved using a sieve having a sieve opening of 250 μm, the portion having a particle diameter of 250 μm or more to account for 30 mass % or less is more preferred.

Here, the particle diameter of the iron-base powder is a value measured by classification in accordance with "Method for Determination of Sieve Analysis of Metal Powders" defined by Japan Powder Metallurgy Association (JPMA P02-1992).

As described above, in the iron-base powder of the invention, the crystal grain size constituting the iron-base powder is large, whereby the coercivity of the powder core can be made small and the hysteresis loss can be reduced. However, for improving the core loss of the powder core, the eddy-current loss needs to be reduced, in addition to the hysteresis loss. For reducing the eddy-current loss, it is sufficient when an insulator is present at the interface between iron-base powders when the iron-base powder is compacted. For allowing an insulator to be present at the interface between iron-base powders, this may be attained, for example, by compacting the iron-base powder of which surface is laminated with an insulating film or by compacting a mixture of the iron-base powder and an insulating powder. Compacting of the iron-base powder of which surface is laminated with an insulating film is preferred.

The insulating film or insulating powder is not particularly limited in its kind, and known insulating film or powder may be used. For example, there may be used an insulating film or insulating powder ensuring that when the resistivity of a compact is measured by a four-terminal method, the resistivity becomes about 50 μΩ·m or more.

As to the material of the insulating film, for example, an inorganic material such as phosphoric acid-based chemical film or chromium-based chemical film, or a resin may be used. Examples of the resin which can be used include a silicone resin, a phenol resin, an epoxy resin, a phenoxy resin, a polyamide resin, a polyimide resin, a polyphenylene sulfide resin, a styrene resin, an acrylic resin, a styrene/acrylic resin, an ester resin, a urethane resin, an olefin resin such as polyethylene, a carbonate resin, a ketone resin, a fluororesin such as fluoromethacrylate and vinylidene fluoride, and an engineering plastic such as PEEK or a modified product thereof.

Of these insulating films, a phosphoric acid-based chemical film may be formed in particular. The phosphoric acid-based chemical film is a glassy film produced by chemical conversion with an orthophosphoric acid ($H_3PO_4$) or the like and is excellent in the electrical insulation.

The thickness of the phosphoric acid-based chemical film is preferably on the order of 1 to 250 nm. Because, when the film thickness is less than 1 nm, the insulation effect can be hardly brought out. However, when the film thickness exceeds 250 nm, the insulation effect is saturated and moreover, densification of the green compact is disadvantageously inhibited. The thickness is, in terms of the coating amount, preferably on the order of 0.01 to 0.8 mass %.

The phosphoric acid-based chemical film preferably contains one or more elements selected from the group consisting of Na, S, Si, W and Co. Because, such an element is considered to inhibit oxygen in the phosphoric acid-based chemical film from forming a semiconductor with Fe during strain-relief annealing at a high temperature and effectively act to suppress the reduction in the resistivity due to strain-relief annealing.

Two or more kinds of these elements may be used in combination. Above all, a combination of Si and W and a combination of Na, S and Co are easy of combination and excellent in the thermal stability, and a combination of Na, S and Co is more preferred.

For allowing the addition of such an element to suppress the reduction in the resistivity even when performing strain-relief annealing at a high temperature, in terms of the amount in 100 mass % of iron powder after the formation of phosphoric acid-based chemical film, P is preferably from 0.005 to 1 mass %, Na is preferably from 0.002 to 0.6 mass %, S is preferably from 0.001 to 0.2 mass %, Si is preferably from 0.001 to 0.2 mass %, W is preferably from 0.001 to 0.5 mass %, and Co is preferably from 0.005 to 0.1 mass %.

Also, the phosphoric acid-based chemical film for use in the invention may contain Mg or B. At this time, in terms of the amount in 100 mass % of iron powder after the formation of phosphoric acid-based chemical film, Mg and B both are preferably from 0.001 to 0.5 mass %.

In the invention, a silicone resin film is preferably further formed on the surface of the phosphoric acid-based chemical film. The silicone resin film has an action of enhancing the thermal stability of electrical insulation and additionally raising the mechanical strength of the powder core. That is, when the crosslinking/curing reaction of the silicone resin is completed (at the compacting of the green compact), an Si—O bond excellent in thermal stability is formed and an insulating film excellent in the thermal stability results. Also, powders are firmly bonded together and therefore, the mechanical strength increases.

A silicone resin allowing slow curing causes sticking of the powder and bad handling after the film formation and therefore, a silicone resin having a larger number of trifunctional T units ($RSiX_3$: X is a hydrolyzable group) than a bifunctional D unit ($R_2SiX_2$: X is the same as above) is preferred. However, when many tetrafunctional Q units ($SiX_4$: X is the same as above) are contained, powders are firmly bound to each other at the preliminary curing and this disadvantageously makes it unable to perform the subsequent compacting step. Accordingly, a silicone resin where a T unit accounts for 60% by mol or more is preferred, a silicone resin where a T unit accounts for 80% by mol or more is more preferred, and a silicone resin where all are a T unit is most preferred.

As for the silicone resin, a methylphenylsilicone resin where R above is a methyl group or a phenyl group is generally used, and those having a larger number of phenyl groups are suggested to have higher heat resistance.

However, in the case where the phosphoric acid-based chemical film contains one or more elements selected from the group consisting of Na, S, Si, W and Co and strain-relief annealing is preformed at a high temperature, the above-described presence of a phenyl group is not so effective. The reason therefor is considered because the bulkiness of the phenyl group disturbs the dense glassy network structure to conversely reduce the thermal stability or the effect of inhibiting formation of a compound with iron. Accordingly, in the case of performing strain-relief annealing at a high temperature, a methylphenylsilicone resin having a methyl group in a ratio of 50% by mol or more (for example, KR255 and KR311 produced by Shin-Etsu Chemical Co., Ltd.) is preferred, a methylphenylsilicone resin having a methyl group in a ratio of 70% by mol or more (for example, KR300 produced by Shin-Etsu Chemical Co., Ltd.) is more preferred, and a methylphenylsilicone resin not having a phenyl group at all (for example, KR251, KR400, KR220L, KR242A, KR240, KR500 and KC89 produced by Shin-Etsu Chemical Co., Ltd.) is most preferred. Incidentally, the ratio between a methyl group and a phenyl group or the functionality of the silicone resin can be analyzed by FT-IR or the like.

The thickness of the silicone resin film is preferably from 1 to 200 nm, more preferably from 1 to 100 nm. Also, the total thickness of the phosphoric acid-based chemical film and the silicone resin film is preferably 250 nm or less. When it exceeds 250 nm, the magnetic flux density may greatly decrease. Also, for reducing the core loss, it is preferred to form the phosphoric acid-based chemical film to a larger thickness than the silicone resin film.

Assuming that the total of the iron powder having formed thereon a phosphoric acid-based chemical film and the silicone resin film is 100 mass %, the coating amount of the silicone resin film is preferably adjusted to be from 0.05 to 0.3 mass %. When the coating amount is less than 0.05 mass %, the insulation is poor and the electric resistance is low, whereas when it exceeds 0.3 mass %, high densification of the compact can be hardly achieved.

In the above, a case of compacting an iron-base powder having laminated thereon an insulating film is mainly described, but the invention is not limited thereto and, for example, a powder obtained by coating an inorganic material such as phosphoric acid-based chemical film or chromium-based chemical film on the surface of the above-described iron-base powder may be mixed with an insulating powder comprising the above-described resin and the mixture may be compacted. The blending amount of the resin is preferably on the order of 0.05 to 0.5 mass % based on the entire mixed powder.

The iron-base powder for a powder core of the invention may further contain a lubricant. By the action of this lubricant, the frictional resistance between powders when compacting the iron-base powder or between the iron-base powder and the inner wall of a compacting die can be reduced, and galling on the compact or heat generation during compacting can be prevented.

In order to effectively bring out such effects, the lubricant is preferably contained in an amount of 0.2 mass % or more based on the entire amount of the powder. However, when the amount of the lubricant is increased, this opposes high densification of the green compact. Therefore, the amount of the lubricant is preferably 0.8 mass % or less. Incidentally, in the case of performing the compacting powder by coating a lubricant on the inner wall surface of the die and then compacting them (die wall), the amount of the lubricant may be less than 0.2 mass %.

As for the lubricant, a conventionally known lubricant may be used and specific examples thereof include a metal salt powder of stearic acid such as zinc stearate, lithium stearate and calcium stearate, a paraffin, a wax and a natural or synthetic resin derivative.

The iron-base powder for a powder core of the invention is of course used for the production of a powder core, but the powder core obtained by compacting the iron-base powder of the invention is included in the invention. This powder core is used mainly as a core of a rotor, stator or the like of a motor which is used with an alternating current.

The iron-base powder of the invention satisfying the above-described requirements is not particularly limited in its production method but may be produced, for example, by heat-treating a raw material iron-base powder in a non-oxidative atmosphere and crushing.

The raw material iron-base powder is a ferromagnetic metal powder and specific examples thereof include a pure iron powder, an iron-base alloy powder (e.g., Fe—Al alloy, Fe—Si alloy, sendust, permalloy) and an amorphous powder.

Such a raw material iron-base powder can be produced, for example, by forming a fine particle by an atomizing method and subjecting the fine particle to reduction and pulverization. Such a production method produces an iron-base powder where the average particle diameter corresponding to 50% of the cumulative particle size distribution in terms of a particle size distribution evaluated by "Method for Determination of Sieve Analysis of Metal Powders" defined by Japan Powder Metallurgy Association (JPMA P02-1992) is approximately from 20 to 250 μm, but in the invention, an iron-base powder where the above-described average particle diameter is 75 to 300 μm is preferably used.

The raw material iron-base powder is heat-treated in a non-oxidative atmosphere. The heat treatment brings about growth of the crystal grain and enables coarsening the crystal grain.

Examples of the non-oxidative atmosphere include a reducing atmosphere (e.g., hydrogen gas atmosphere, hydrogen gas-containing atmosphere), a vacuum atmosphere and an inert gas atmosphere (e.g., argon gas atmosphere, nitrogen gas atmosphere).

The heat treatment temperature may be sufficient when it is set to a temperature where growth of the crystal grain occurs, and is approximately from 800 to 1,100° C., though this is not particularly limited. When it is less than 800° C., growth of the crystal grain takes too much time, which is inappropriate to practical operation, whereas when it exceeds 1,100° C., growth of the crystal grain occurs in a short time and the crystal grain is coarsened, but sintering also proceeds in addition to the growth of crystal grain and a lot of energy is uselessly required for the crushing after heat treatment.

The heat treatment time is also not particularly limited and may be set in a range where growth of the crystal grain occurs and the crystal grain grows to a desired crystal grain size. At this time, growing the crystal grain to a desired size may be attained by raising the heat treatment temperature or when a low heat treatment temperature is employed, by lengthening the heat treatment time, and the powder after the heat treatment may be crushed and pulverized. Also, the crystal grain may be coarsened to a desired size by repeating the heat treatment and the crushing.

After heat treatment and crushing, the grain size is regulated by classification in accordance with "Method for Determination of Sieve Analysis of Metal Powders" defined by Japan Powder Metallurgy Association (JPMA P02-1992), whereby the iron-base powder of the invention can be obtained.

The method for laminating an insulating film on the iron-base powder of the invention is described below. In the following, a case of laminating a phosphoric acid-based chemical film and a silicone resin film on the surface of the iron-base powder in this order as the insulating film is described.

For laminating a phosphoric acid-based chemical film as the insulating film on the surface of the iron-base powder obtained above by classification, this may be attained by dissolving an orthophosphoric acid ($H_3PO_4$: P source) or the like in an aqueous solvent, mixing the resulting solution (treating solution) with the iron-base powder, and drying.

Also, in the case where the phosphoric acid-based chemical film contains one or more elements selected from the group consisting of Na, S, Si, W and Co, a solution (treating solution) obtained by dissolving a compound containing an element intended to be incorporated into the film is mixed with the iron-base powder, and the powder is dried, whereby the film can be formed.

Examples of the compound which can be used include $Na_2HPO_4$ (P and Na sources), $Na_3[PO_4.12WO_3].nH_2O$ (P, Na and W sources), $Na_4[SiW_{12}O_{40}].nH_2O$ (Na, Si and W sources), $Na_2WO_4.2H_2O$ (Na and W sources), $H_2SO_4$ (S source), $H_3PW_{12}O_{40}.nH_2O$ (P and W sources), $SiO_2.12WO_3.26H_2O$ (Si and W sources), MgO (Mg source), $H_3BO_3$ (B source), $CO_3(PO_4)_2$ (P and Co sources), and $Co_3(PO_4)_2.8H_2O$ (P and Co sources).

As for the aqueous solvent, water, a hydrophilic organic solvent such as alcohol and ketone, or a mixture thereof may be used, and if desired, a known surfactant may be added to the solvent.

In laminating a phosphoric acid-based chemical film, a treating solution having a solid content of approximately from 0.1 to 10 mass % is prepared and added in an amount of approximately from 1 to 10 parts by mass based on 100 parts by mass of the iron-base powder and after mixing by a known mixing machine (e.g., mixer, ball mill, kneader, V-type mixing machine, granulator), the mixture is atmospherically dried at 150 to 250° C. under reduced pressure or vacuum, whereby an iron-base powder having formed thereon a phosphoric acid-based chemical film is obtained.

In the case of further forming a silicone resin film on the surface of the phosphoric acid-based chemical film, a silicon resin is dissolved, for example, in alcohols or a petroleum-based organic solvent such as toluene and xylene, the resulting solution is mixed with the iron-base powder having formed thereon a phosphoric acid-based chemical film, and the organic solvent is evaporated, whereby the silicone resin film can be formed.

The film forming conditions are not particularly limited, but a resin solution prepared to have a solid content of approximately 2 to 10 mass % may be added in an amount of approximately from 0.5 to 10 parts by mass based on 100 parts by mass of the iron-base powder having formed thereon a phosphoric acid-based chemical film and after mixing, the mixture may be dried. When the amount added is less than 0.5 parts by mass, mixing takes much time, whereas when it exceeds 10 parts by mass, drying takes much time or a non-uniform film may be formed. The resin solution may be appropriately heated in advance.

As for the mixing machine, the same as those described above may be used. However, in the case of forming a silicone resin film, the organic solvent may be evaporated by drying under heating. The drying under heating may be performed by heating in an oven or the like or by warming a mixing vessel with hot water or the like. After drying, it is preferably passed through a sieve having a sieve opening of about 500 μm.

It is recommended to preliminarily cure the silicone resin film after drying. By crushing after preliminarily curing the silicone resin, a powder excellent in flowability is obtained and the powder can be smoothly fed like sand into the compacting die at compacting. When the silicone resin is not preliminarily cured, powders may adhere to each other, for example, at the warm compacting, making it difficult to add the powder into the compacting die in a short time. Preliminary curing is very useful for enhancing the handleability in view of practical operation. Also, it is found that when the silicone resin is preliminary cured, the resistivity of the obtained powder core is greatly enhanced. The reason therefor is not clearly known but is considered because adherence to the iron powder at the curing is increased.

The preliminary curing is specifically performed by a heat treatment at 100 to 200° C. for 5 to 100 minutes. A heat treatment at 130 to 170° C. for 10 to 30 minutes is more preferred. Also after the preliminary curing, as described above, it is preferably passed through a sieve having a sieve opening of about 500 μm.

In producing a powder core, the powder after forming the insulating film on the surface of the iron-base powder (for example, the iron-base powder on which a phosphoric acid-based chemical film is formed, or the iron-base powder where a silicone resin film is further formed on the surface of the phosphoric acid-based chemical film) may be compacted and then annealed for strain relief.

The compacting method is not particularly limited, and a known method may be employed. The suitable condition of compacting is, in terms of the surface pressure, from 490 to 1,960 MPa (more preferably from 790 to 1,180 MPa).

The green density of the compact obtained after compacting is not particularly limited but is, for example, preferably 7.5 g/cm$^3$ or more. When the green density is 7.5 g/cm$^3$ or more, the strength and magnetic property (magnetic flux density) can be made more excellent. For obtaining a compact having a green density of 7.5 g/cm$^3$ or more, this may be attained by setting the surface pressure at compacting to 980 MPa or more. As for the compacting temperature, either room temperature compacting or warm compacting (100 to 250° C.) may be employed. Warm compacting by die wall lubrication forming is preferred, because a high-strength powder core can be obtained.

After the compacting, strain-relief annealing is performed for reducing the hysteresis loss of the powder core. The conditions of strain-relief annealing are not particularly limited, and known conditions may be applied.

Above all, when the phosphoric acid-based chemical film contains one or more elements selected from the group consisting of Na, S, Si, W and Co, the temperature at strain-relief annealing can be set to be higher than ever before and the hysteresis loss of the powder core can be more reduced. At this time, the temperature of strain-relief annealing is preferably 400° C. or more, and unless the resistivity deteriorates, the strain-relief annealing is preferably performed at a higher temperature.

The atmosphere in which strain-relief annealing is performed is not particularly limited as long as oxygen is not contained, but an inert gas atmosphere such as nitrogen is preferred. The time for which strain-relief annealing is preformed is not particularly limited but is preferably 20 minutes or more, more preferably 30 minutes or more, still more preferably 1 hour or more.

In the foregoing pages, a case of compacting the iron-base powder of the invention after lamination of an insulating film is described, but the invention is not limited thereto, and a powder obtained by coating an inorganic material such as phosphoric acid-based chemical film or chromium-based chemical film on the surface of the iron-base powder may be mixed an insulating powder comprising the above-described resin and the mixture may be compacted.

EXAMPLES

The invention is described in greater detail below by referring to Examples, but the following Examples are not intended to limit the invention and may be implemented by making appropriate modifications within a range of not deviating from the intent and spirit indicated above or later and these modifications all are included in the technical scope of the invention.

Example 1

An atomized powder "ATOMEL 300NH" produced by Kobe Steel, Ltd. was sieved using a sieve having a sieve opening of 250 μm in accordance with "Method for Determination of Sieve Analysis of Metal Powders" defined by Japan Powder Metallurgy Association (JPMA P02-1992), the powder passed through the sieve was collected and reduced at 970° C. for 2 hours in a hydrogen gas atmosphere. After reduction, the powder was crushed and passed through a sieve having a sieve opening of 250 μm or 425 μm. The powder passed through the sieve accounted for 95 mass % or more.

The powder passed through the sieve was sieved using a sieve having a sieve opening of 45 μm, 63 μm, 75 μm, 106 μm, 150 μm, 180 μm or 250 μm, and the powder remaining on the sieve was collected. The particle diameter of each powder is shown in Table 1 below. The proportion of the powder remaining on each sieve was 99 mass % or more.

The surface of the powder shown in Table 1 below was subjected to an insulating treatment of forming a phosphoric acid-based chemical film and then forming a silicone resin film (corresponding to Nos. 1 to 8 in Table 1), or the surface of the powder shown in Table 1 below was subjected to a heat treatment under the following conditions and then to an insulating treatment of forming a phosphoric acid-based chemical film and further forming a silicone resin film (corresponding to Nos. 9 to 16 in Table 1).

[Heat Treatment Conditions]

In the heat treatment, a process of heat-treating the powder shown in Table 1 below at 970° C. for 2 hours in a hydrogen gas atmosphere and then crushing the powder was repeated three times to obtain an iron-base powder. After repeating the process three times, the particle size of the powder was regulated by classification using various sieves in the same manner as above. The particle diameter of the powder after heat treatment is shown in Table 1 below.

The cross section of the powder after particle size regulation [the powder before heat treatment for the powders not subjected to heat treatment (Nos. 1 to 8), and the powder after heat treatment for the powders subjected to heat treatment (Nos. 9 to 16)] was observed, and the crystal grain size observed in the cross section of the iron-base powder was measured. A distribution of this crystal grain size is prepared, and the crystal grain size corresponding to 10% (D10) when counted from the minor crystal grain size side, a crystal grain size corresponding to 20% (D20), and a crystal grain size corresponding to 30% (D30) were determined. The crystal grain sizes at D10 to D30 are shown in Table 1 below. Incidentally, in observing the cross-section of the powder, an optical microscope was used and the observation was performed at a magnification of 200. At this time, 50 powder particles where the powder had a cross-sectional diameter within the particle size distribution were observed and by measuring the crystal grain size on each iron-base powder, a crystal grain size distribution containing at least the maximum crystal grain size was obtained. The crystal grain size was measured on 50 to 150 crystal grains.

[Insulating Treatment Conditions]

In forming a phosphoric acid-based chemical film, 1,000 parts of water, 70 parts of $H_3PO_4$, 270 parts of sodium phosphate [$Na_3PO_4$], 70 parts of hydroxylamine sulfate [$(NH_2OH)_2H_2SO_4$] and 100 parts of cobalt phosphate octahydrate [$Co_3(PO_4)_2.8H_2O$] were mixed to prepare a stock solution, 50 parts of a treating solution obtained by 20-fold diluting the stock solution was added to 1,000 parts of the powder above, and after mixing for 5 to 60 minutes by using a V-type mixing machine, the powder was atmospherically dried at 200° C. for 30 minutes and then passed through a sieve having a sieve opening of 300 μm. The thickness of the phosphoric acid-based chemical film was about 50 nm.

In forming a silicone resin film, "KR220L" (methyl group: 100% by mol, T unit: 100% by mol) produced by Shin-Etsu Chemical Co., Ltd. was dissolved in toluene to prepare a resin solution having a solid content concentration of 2 mass %, the resin solution was added to and mixed with the iron powder to give a resin solid content of 0.1%, and the mixture was dried by heating (75° C. for 30 minutes). That is, assuming that the amount of the iron-base powder having formed thereon a silicone resin film is 100 mass %, the coating amount of the silicone resin film was 0.1 mass %.

Subsequently, the powder after the insulating treatment was subjected to a preliminary curing treatment (atmospherically at 150° C. for 30 minutes) and then compacted into a compact. In the compacting, zinc stearate dispersed in an alcohol was coated on the die surface, and the powder subjected to preliminary curing treatment was fed into the die and compacted at room temperature (25° C.) by applying a pressure of about 10 ton/cm$^2$ (980 MPa) in terms of the surface pressure to yield a compact having a green density of 7.50 g/cm$^3$. The compact had a ring-like shape with an outer diameter of 45 mm, an inner diameter of 33 mm and a thickness of about 5 mm, where the primary winding was 400 turns and the secondary winding was 25 turns.

The coercivity of the compact was measured using a direct current magnetization B—H characteristic automatic recording apparatus "model BHS-40" manufactured by Riken Denshi) by setting the maximum excitation magnetic field (B) to 50 (Oe). The measurement results are shown together in Table 1 below.

TABLE 1

| No. | Particle Diameter Before Heat Treatment (μm) | Heat Treatment | Particle Diameter After Heat Treatment (μm) | Crystal Grain Size at D10 (μm) | Crystal Grain Size at D20 (μm) | Crystal Grain Size at D30 (μm) | Coercivity of Compact (Oe) |
|---|---|---|---|---|---|---|---|
| 1 | 250 or less | none | — | 3 | 9 | 26 | 4.62 |
| 2 | 45 to 250 | none | — | 3 | 9 | 27 | 4.56 |
| 3 | 63 to 250 | none | — | 3 | 9 | 28 | 4.50 |
| 4 | 75 to 250 | none | — | 3 | 9 | 30 | 4.43 |
| 5 | 106 to 250 | none | — | 4 | 10 | 32 | 4.34 |
| 6 | 150 to 250 | none | — | 4 | 10 | 33 | 4.27 |
| 7 | 180 to 250 | none | — | 4 | 10 | 33 | 4.27 |
| 8 | 250 to 425 | none | — | 4 | 10 | 31 | 4.12 |
| 9 | 250 or less | done | 250 or less | 3 | 15 | 30 | 4.41 |
| 10 | 45 to 250 | done | 45 to 250 | 4 | 18 | 34 | 4.20 |
| 11 | 63 to 250 | done | 63 to 250 | 10 | 20 | 40 | 3.92 |
| 12 | 75 to 250 | done | 75 to 250 | 15 | 22 | 50 | 3.35 |
| 13 | 106 to 250 | done | 106 to 250 | 15 | 25 | 55 | 3.32 |
| 14 | 150 to 250 | done | 150 to 250 | 15 | 30 | 60 | 3.30 |
| 15 | 180 to 250 | done | 180 to 250 | 15 | 30 | 60 | 3.29 |
| 16 | 250 to 425 | done | 250 to 425 | 20 | 40 | 75 | 3.13 |

Table 1 reveals the followings. In Nos. 1 to 11, the crystal grain size at D30 is less than 50 μm. Accordingly, when the cross section of the iron-base powder is observed and the crystal grain size observed in the cross section of the iron-base powder is measured, the proportion of the powder having a crystal grain size of 50 μm or more is small, as a result, the coercivity of the compact is large and the hysteresis loss cannot be reduced. On the other hand, in Nos. 12 to 16, the crystal grain size at D30 is 50 μm or more. Accordingly, when the cross section of the iron-base powder is observed and the crystal grain size observed in the cross section of the iron-base powder is measured, the proportion of the powder having a crystal grain size of 50 μm or more is large, as a result, the coercivity of the compact becomes small and the hysteresis loss of the compact can be reduced.

Example 2

The relationship among the heat treatment conditions, the crystal grain size and the coercivity was examined. The crystal grain size at D30 was measured under the same conditions as in No. 14 of Example 1 except that the conditions of heat treatment were changed as shown in Table 2 below. The results are shown in Table 2 below.

The insulating treatment was subjected in the same manner as in No. 14 of Example 1 and then to a preliminary curing treatment was subjected (atmospherically at 150° C. for 30 minutes) and thereafter, this was compacted. The compacting was performed in the same manner as in Example 1 and the powder was compacted to yield a compact having a green density of 7.50 g/cm$^3$.

The coercivity of the compact was measured under the same conditions as in Example 1. The measurement results are shown together in Table 2 below.

TABLE 2

| No. | Particle Diameter Before Heat Treatment (μm) | Conditions of Heat Treatment: Temperature (° C.) | Time (hour) | Number of Times | Particle Diameter After Heat Treatment (μm) | Crystal Grain Size at D30 (μm) | Coercivity After Compacting (Oe) |
|---|---|---|---|---|---|---|---|
| 21 | 150 to 250 | 970 | 2 | 1 | 150 to 250 | 45 | 4.40 |
| 22 | 150 to 250 | 970 | 2 | 2 | 150 to 250 | 50 | 3.52 |
| 23 | 150 to 250 | 970 | 2 | 3 | 150 to 250 | 60 | 3.30 |
| 24 | 150 to 250 | 970 | 2 | 4 | 150 to 250 | 60 | 3.20 |
| 25 | 150 to 250 | 970 | 4 | 1 | 150 to 250 | 50 | 3.51 |
| 26 | 150 to 250 | 970 | 4 | 2 | 150 to 250 | 65 | 3.15 |

Table 2 reveals the followings. When the heat treatment time is lengthened, the crystal grain size is coarsened, as a result, the coercivity of the powder core can be reduced. Also, with the same heat treatment temperature and the same heat treatment time, as the heat treatment is repeated a larger number of times, the crystal grain size is more coarsened and the coercivity of the compact can be more reduced.

Example 3

The relationship between the kind of the insulating film and the core loss was examined. Iron-base powders (Nos. 31 to 46) where the insulting film was formed under the same conditions as in Nos. 1 to 16 of Example 1 except for changing the kind of the insulating film were obtained. Three kinds of insulating films were formed, that is, (1) only a silicone resin film was formed; (2) only a phosphoric acid-based chemical film was formed; and (3) a silicone resin film was formed on the surface of a phosphoric acid-based chemical film. Incidentally, the laminate structure of (3) is the same as those in Example 1.

The iron-base powder having formed thereon an insulating film was classified using various sieves by the same method as above to regulate the particle size of the powder.

Subsequently, the powder after particle size regulation was subjected to a preliminary curing treatment (atmospherically at 150° C. for 3 minutes) and then compacted. The compacting was performed in the same manner as in Example 1 and it was compacted to yield a compact having a green density of 7.50 g/cm$^3$. After compacting, strain-relief annealing was performed at 450° C. for 30 minutes in a nitrogen atmosphere. The temperature rise rate was about 50° C./min, and after stain-relief annealing, the compact was furnace-cooled. The core loss of the obtained compact was measured using an automatic magnetic tester "Y-1807" manufactured by Yokogawa Electric Corporation at a frequency of 200 Hz and an excitation magnetic flux density of 1.5 T. The results were evaluated according to the following criteria, and the evaluation results are shown together in Table 3.

[Criteria]

A: The core loss was 40 W/kg or less.

B: The core loss was from more than 40 W/kg to less than 50 W/kg.

C: The core loss was 50 W/kg or more.

TABLE 3

| | | Evaluation Results of Core Loss | | |
|---|---|---|---|---|
| No. | No. in Table 1 | Silicone Resin Film | Phosphoric Acid-Based Chemical film | Phosphoric Acid-Based Chemical film + Silicone Resin Film |
| 31 | 1 | C | C | B |
| 32 | 2 | C | C | B |
| 33 | 3 | C | C | B |
| 34 | 4 | C | B | B |
| 35 | 5 | C | B | B |
| 36 | 6 | C | B | B |
| 37 | 7 | C | B | B |
| 38 | 8 | C | B | B |
| 39 | 9 | C | B | B |
| 40 | 10 | C | B | B |
| 41 | 11 | C | B | B |
| 42 | 12 | C | A | A |
| 43 | 13 | C | A | A |
| 44 | 14 | C | A | A |
| 45 | 15 | C | A | A |
| 46 | 16 | C | A | A |

Table 3 reveals the followings. Reducing the core loss by making small the eddy-current loss is attained when the iron-base powder has a large crystal grain size and a large particle diameter and on the surface of the iron-base powder, a phosphoric acid-based chemical film is formed or a phosphoric acid-based chemical film and a silicone resin film are formed in this order.

Example 4

The relationship between the composition of the phosphoric acid-based chemical film and the resistivity was examined. An insulating treatment was performed by forming a phosphoric acid-based chemical film and a silicone resin film on the iron-base powder in the same manner as in Example 1 except that in No. 14 shown in Table 1 of Example 1, the composition of the phosphoric acid-based chemical film was changed. Incidentally, in forming the phosphoric acid-based chemical film, the composition of the phosphoric acid-based chemical film was changed by using stock solutions each having a composition shown below.

Stock Solution Used in No. 51:

1,000 Parts of water and 193 parts of $H_3PO_4$

Stock Solution Used in No. 52:

1,000 Parts of water, 193 parts of $H_3PO_4$, 31 parts of MgO and 30 parts of $H_3BO_3$ Stock Solution Used in No. 53:

1,000 Parts of water, 193 parts of $H_3PO_4$, 31 parts of MgO, 30 parts of $H_3BO_3$ and 143 parts of $H_3PW_{12}O_{40}.nH_2O$ Stock Solution Used in No. 54:

1,000 Parts of water, 193 parts of $H_3PO_4$, 31 parts of MgO, 30 parts of $H_3BO_3$ and 143 parts of $SiO_2.12WO_3.26H_2O$ Stock Solution Used in No. 55:

1,000 Parts of water, 270 parts of $Na_2HPO_4$, 70 parts of $H_3PO_4$ and 70 parts of $(NH_2OH)_2H_2SO_4$ Stock Solution Used in No. 56:

1,000 Parts of water, 70 parts of $H_3PO_4$, 270 parts of $Na_3PO_4$, 70 parts of $(NH_2OH)_2H_2SO_4$ and 100 parts of $Co_3(PO_4)_2.8H_2O$ The powder after the insulating treatment was subjected to a preliminary curing treatment (atmospherically at 150° C. for 30 minutes) and then compacted. The compacting was performed in the same manner as in Example 1, and the powder was compacted to yield a compact having a green density of 7.50 g/cm$^3$. Incidentally, the dimension of the compact was 31.75 mm×12.7 mm×about 5 mm (thickness).

After compacting, strain-relief annealing was performed at 550° C. for 30 minutes in a nitrogen atmosphere. The temperature rise rate was about 50° C./min, and after stain-relief annealing, the compact was furnace-cooled. The resistivity of the obtained compact was measured using a digital multimeter "VOAC-7510" manufactured by Iwatsu Electric Co., Ltd., and the measurement results are shown in Table 4.

TABLE 4

| No. | Additive Element in Phosphoric Acid-Based Chemical film | Resistivity (μΩ · m) |
|---|---|---|
| 51 | P | 20 |
| 52 | P, Mg, B | 30 |
| 53 | P, W, Mg, B | 80 |
| 54 | P, W, Si, Mg, B | 90 |
| 55 | P, Na, S | 140 |
| 56 | P, Na, S, Co | 160 |

As seen from Table 4, in Nos. 52 to 56 where any one or more elements of Na, S, Si, W and Co are contained in the phosphoric acid-based chemical film, the resistivity at a high temperature is high as compared with No. 51 where such an element is not contained. Above all, in Nos. 55 and 56 where Na and S are used in combination, very good performance is exhibited.

While the invention has been described in detail and with reference to specific embodiments thereof, it will be apparent to one skilled in the art that various changes and modifications can be made therein without departing from the spirit and scope thereof.

This application is based on Japanese Patent Application (Patent Application No. 2006-245920) filed on Sep. 11, 2006, the entirety of which is incorporated herein by reference.

Also, all references cited are incorporated herein by reference in their entirety.

INDUSTRIAL APPLICABILITY

According to the invention, the crystal grain size constituting individual iron-base powder particles is made large, whereby the coercivity of the powder core becomes small and in turn, the hysteresis loss can be reduced. Also, according to the invention, an insulating film is formed on the surface of the iron-base powder made to have a large crystal grain size and the eddy-current loss as well as the hysteresis loss can be thereby reduced, so that an iron-base powder capable of producing a powder core reduced in the core loss can be provided. Furthermore, according to the invention, a powder core reduced in both the hysteresis loss and the eddy-current loss and having a small core loss can be provided.

The invention claimed is:

1. An iron-base powder for a powder core, wherein when cross-sections of at least 50 iron-base powders are observed and a crystal grain size distribution comprising at least a maximum crystal grain size is determined by measuring a crystal grain size of each iron-base powder, 70% or more of the crystal grain size is 50 μm or more, and the iron-base powder comprises an insulating film present on a surface of the iron-base powder, wherein the insulating film is a chemical film of a phosphoric acid comprising Co.

2. The iron-base powder according to claim 1, wherein when the iron-base powder is sieved using a sieve having a sieve opening of 75 μm, the iron-base powder which does not pass through the sieve accounts for 80 mass % or more.

3. The iron-base powder according to claim 1, further comprising a silicone resin film present on a surface of the chemical film.

4. A powder core obtained by a method comprising compacting the iron-base powder according to claim 1, wherein the powder core has a green density of 7.5 g/cm$^3$ or more.

5. An iron-base powder for a powder core, wherein when cross-sections of at least 50 iron-base powders are observed and a crystal grain size distribution comprising at least a maximum crystal grain size is determined by measuring a crystal grain size of each iron-base powder, 70% or more of the crystal grain size is 50 μm or more, and the iron-base powder comprises an insulating film present on a surface of the iron-base powder, wherein the insulating film is a chemical film of a phosphoric acid comprising Co and at least one elements selected from the group consisting of Na, S, Si, and W.

6. The iron-base powder according to claim 5, wherein when the iron-base powder is sieved using a sieve having a sieve opening of 75 μm, the iron-base powder which does not pass through the sieve accounts for 80 mass % or more.

7. The iron-base powder according to claim 5, further comprising a silicone resin film present on a surface of the chemical film.

8. A powder core obtained by a method comprising compacting the iron-base powder according to claim 5, wherein the powder core has a green density of 7.5 g/cm$^3$ or more.

* * * * *